United States Patent [19]

Stearns

[11] 4,196,6

[45] Apr. 8, 19

[54] PRESSURE OPERATED VALVE ACTUATOR

[76] Inventor: Frank A. Stearns, 7403 Flowerdale, Houston, Tex. 77055

[21] Appl. No.: 877,325

[22] Filed: Feb. 13, 1978

[51] Int. Cl.[2] ..... F01B 3/04

[52] U.S. Cl. ..... 92/33; 92/31

[58] Field of Search ..... 92/31, 33; 251/58; 74/99 A, 107, 99 R

[56] References Cited

U.S. PATENT DOCUMENTS

| | | | |
|---|---|---|---|
| 2,942,580 | 6/1960 | Siravd | 92/31 |
| 2,987,888 | 6/1961 | Crowell | 92/33 |
| 3,255,806 | 6/1966 | Meyer et al. | 92/33 X |
| 3,523,564 | 8/1970 | Jonsson et al. | 92/31 X |
| 3,911,793 | 10/1975 | Izumi | 92/33 |

*Primary Examiner*—Irwin C. Cohen

*Attorney, Agent, or Firm*—Donald Gunn

[57] ABSTRACT

A pressure operated valve actuator is disclosed. In preferred embodiment, fluid under pressure is int duced at either end to actuate the device. The dev includes a cylindrical body having top and bottom e caps which close the body. On the interior, there i central shaft which is rotated. A piston traverses internal cavity of the housing, the piston being urged pressure introduced above or below the piston. T piston is prevented from rotation by specified gu posts. As the piston traverses the length of the appa tus, engagement is made by the piston and the cent shaft with helical grooves receiving a ball bearing. T achieves rotational motion from the linear movement the piston to the central shaft. This rotational mo ment is imparted to the shaft, and, dependent on sc factors, a specified amount of rotation, such as o quarter turn, can be obtained. The apparatus functic bidirectionally.

7 Claims, 4 Drawing Figures

PRESSURE OPERATED VALVE ACTUATOR

BACKGROUND OF THE DISCLOSURE

The present invention is directed to a valve operator for providing a quarter turn to a valve. Many valves, such as ball, plug or other stem-mounted valves, operate with one-quarter turn between a full open and a full closed position. On small valves, very little force is required. On large valves, opening against significant pressure levels, very substantial torque is required to open or close the valve. The present invention is directed to a valve operator which can provide substantial torque. Yet, the valve operator is easily installed so that only one-quarter of a revolution is delivered. Heretofore, hydraulic or pneumatic valve actuators have utilized a piston and cylinder arrangement where the piston is connected to a piston rod, and the piston rod, in turn, rotates an eccentric arm via a clevis connection. With such a typical installation, there are difficulties in scaling the linear stroke of the piston and cylinder arrangement to the dimensions of the eccentric whereby ninety degrees (90°) of rotation is achieved at the stem. The present invention overcomes these difficulties. It provides a valve operator adapted to be connected to a quarter turn valve and, in particular, enables in line connection between the valve stem and the rotatable shaft of the operator. Such an arrangement is compact and avoids exposed eccentric arms and the like. This, of course, increases operator safety and reduces the chance of foreign devices becoming entangled to the detriment of safety and reliability.

The present invention is a fluid powered valve actuator. Fluid power is quite often readily available at a given installation. Fluid power is easily adapted for the present invention by providing a valve which delivers the fluid power to the fluid actuated operator. When fluid is delivered, it drives the actuator to one extreme or the other of its movement. Fortunately, the device is constructed and arranged so that only one-quarter of a revolution is provided. This is advantageous because there is no need to construct external limit switches, stops or motion limiting devices which restrain the stroke of the equipment to one-quarter turn. Accordingly, the only thing which is exposed in the present apparatus is the central shaft in the valve actuator, and this enables the valve to be connected at either end. The other end is left exposed as desired, and it can be capped if necessary. This is highly convenient and provides extremely safe equipment with almost no exposed moving parts.

The present invention is particularly adapted to be used with a pneumatic power source. Pneumatic power at a specified pressure is applied through a control valve to the fluid actuated device. In the event that significant resistance is encountered, pressure builds up internally in the actuator and achieves a level sufficient to drive the actuator. As the pressure build-up is achieved, the device responds to operate the connected valve. Such an operation is achieved by applying torque to the valve to be rotated, the measure of torque being proportionate to the pressure applied to the actuator.

BRIEF DESCRIPTION OF THE DISCLOSED APPARATUS

This apparatus is a fluid pressure operated actuator for a valve providing a quarter turn for opening and closing valves. It incorporates an elongate, cylindrical housing having top and bottom closure plates. Flu under pressure is applied at either end to operate tl device. The device includes a central stem or sha which is adapted to be connected to the valve to b operated, and the shaft is rotated through a quarter tu in either direction. Rotation is achieved by movem of a guided piston in the cylinder which is connecte via a ball bearing in a helical groove in the shaft t convert axial movement of the piston into rotation movement. The piston extends transversely of the cyli drical cavity and closes it off so that separate upper an lower pressure chambers are defined. A pressure diffe ential acting across the piston drives it from one end t the other.

The piston is guided and prevented from rotating b lengthwise guide rods passing through the pisto Moreover, the piston supports a central sleeve havin helical grooves formed in it cooperative with groov in the shaft. The grooves cooperate to receive a ba bearing so that movement of the piston is converted int rotational movement of the central shaft.

DETAILED DESCRIPTION OF THE ILLUSTRATED EMBODIMENT

Figure 1:
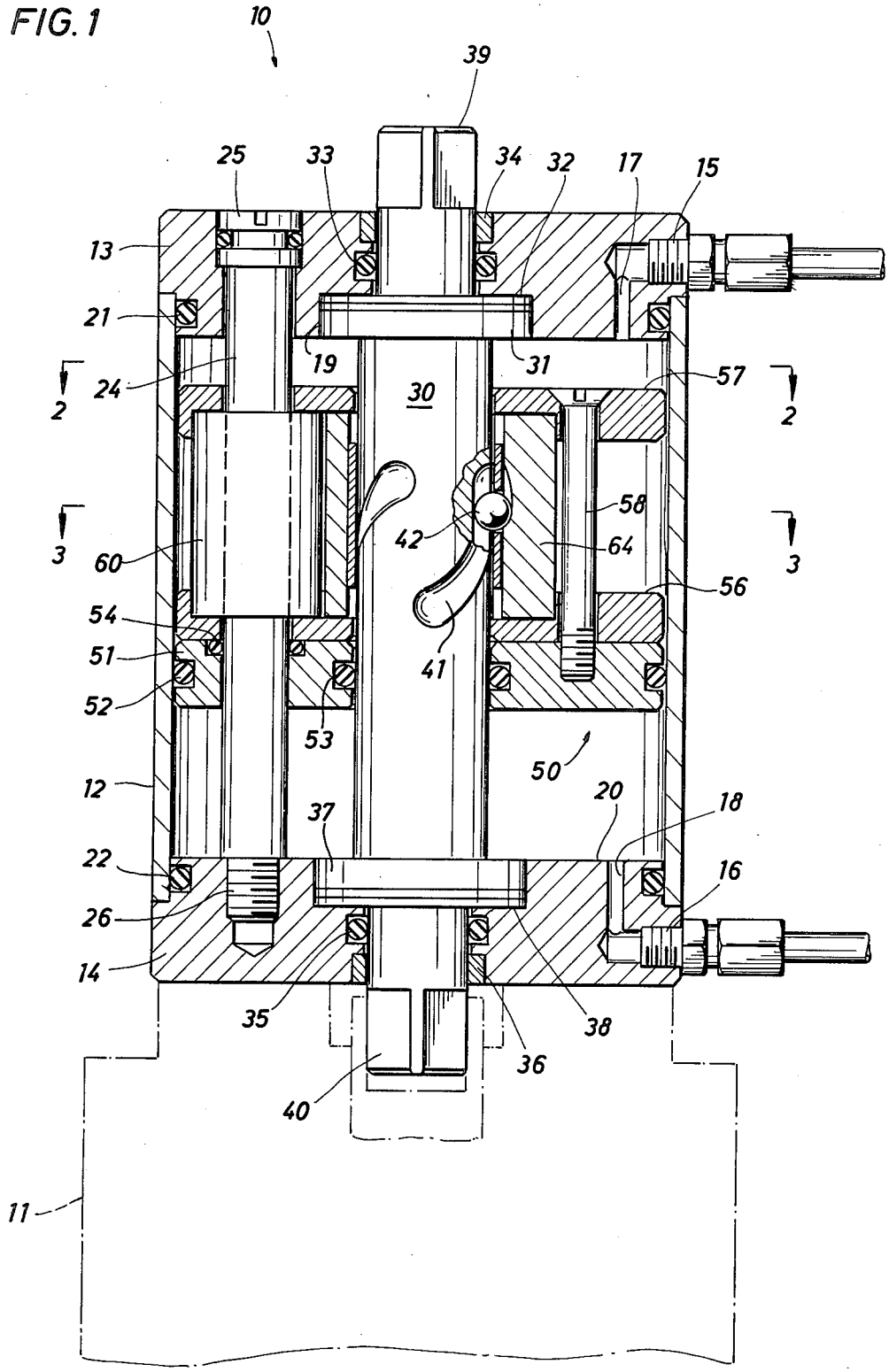
FIG. 1 is a sectional view through the improved flui actuated operator of the present invention showin internal details of construction.

Attention is directed to FIG. 1 of the drawings wher the fluid actuated valve operator is identified by th numeral 10. It is adapted to be joined to a suitable valv having some type of structure, and a valve is indicate in dotted line at 11. The valve is one which is typicall operated by a one-quarter turn of rotation, that is, rot tion from a full open to a full closed position throug ninety degrees (90°). The valve operator has a protruc ing, rotatable shaft which connects with a valve stem In FIG. 1 of the drawings, the numeral 12 identifie an elongate, cylindrical, hollow housing. It is symmetr cally constructed at both ends. At the upper end, transversely extending, thick, closure end plate 13 i located, and this is matched by a similar end closur plate 14 at the opposite end. The two are symmetrical i construction. The device of the present invention ca drive a valve at either end. This permits it to be installe in practically any suitable posture.

The end closure plates 13 and 14 each incorporate a inlet or outlet, as the case may be. The plate 13 incorp rates a threaded opening 15, while the plate 14 has a inlet at 16. Suitable fittings connect at 15 and 16 t enable fluid to be delivered under pressure to the actu tor 10.

The threaded fittings 15 and 16 open into passages 1 and 18 which extend into the cylinder 12. The passage 17 and 18 introduce fluid into or remove it from th der 12. The end cover plates 13 and 14 further de transversely extending, flat, opposing faces 19 20 which define the limits of motion permitted to a n, as will be described. The facing end faces 19 and xtend fully across the circular cross section cap- l within the cylinder 12. The end plates further de encircling seal means at 21 and 22, the seals ıg the preferred form of a groove with an O-ring ved in it. The end plates position the O-ring against cylindrical shell 12 to prevent leakage along the where connection is achieved.

ıe two end closure plates are pulled together. They ıeld together by elongate threaded rods. The nu- l 24 identifies a first rod, and there are preferably arranged at 120° intervals around the circular ture. The rod 24 joins to an enlarged head 25 h is received in a suitably counterbored, drilled in the end plate 13. In the end plate 14, the numeral entifies a drilled and tapped opening for receiving ower end of the rod. The rod is threaded at the r end and does not require threads along its central on between the head and the threads. Indeed, the hreaded central portion comprises a substantial of the length of the rod 24, and it is ideally a th, cylindrical surface for reasons to be discussed. use of three rods pulls the two end plates toward another and thereby clamps the cylindrical shell 12 een them. The head 25 has an O-ring groove for ng purposes. It threads to matching threads on the ıe end plate 13 is centrally drilled to receive a shaft The shaft 30 is supported on a bearing assembly 31 h is received against a counterbored shoulder 32 in nd plate 13. The shaft 30 extends through the end . A seal assembly is formed between the shaft 30 the end plate. The seal assembly includes an O-ring 33 and a bronze bushing 34 inserted at the end. The ıg 33 and the bushing 34 prevent leakage along the 30. The opposite end of the equipment is similarly tructed to include an O-ring seal 35 and an adjacent ing 36. They capture the shaft 30, cooperative with aring assembly 37 which is received in a counter- 38.

ıe shaft 30 is constructed in a very specific manner. ıs a large or thicker central portion between the ing assemblies 31 and 37. It includes a circular or d stub end portion at each end, and each end por- terminates in a square socket drive identified by the erals 39 and 40. The socket drives 39 and 40 are ily engaged by mating socket drive connectors. y enable connection of the valve actuator to a e. It is relatively easy to connect to the square lders on the socket drive.

ıe shaft 30 is provided with a helical groove 41. The al groove cooperates with a ball bearing 42. The bearing is placed in the helical groove. It is free to e from one end to the other of the helical groove. groove and bearing arrangement is duplicated at locations in the preferred embodiment which are ted 120° from one another around the shaft 30. It is ved that a description of one can be extended to all because they function in the same manner. This ides three point contact with a piston assembly, as be described. The three points of contact are lo- d equidistant from one another around the shaft so the lateral loads experienced by the shaft are equal balanced.

The numeral 50 indicates a movable piston assembly. It incorporates a transverse, centrally perforated, piston plate 51. The plate 51 has an external groove and O-ring at 52 to seal against the inside surface of the cylindrical shell 12. It includes another groove and O-ring at 53 which seals against the surface of the shaft 30. The piston plate 51 travels upwardly as viewed in FIG. 1, but it does not have to pass over the helical grooves 41, and, therefore, no leakage occurs at the grooves.

The piston plate 51 is perforated so that the bolt 24 can pass through it. Again, a seal 54 formed of an O-ring in a groove surrounding the bolt 24. The bolt 24 serves as a guide constraining rotational movement of the piston plate 51. It will be recalled that the preferred embodiment utilizes three or more. The piston plate 51 is permitted to travel to and fro but is prevented from rotation by the bolt 24 which passes through it.

The piston plate 51 is immediately adjacent to a lower plate 56 which is sandwiched against it. The plate 56 has approximately the same cross sectional shape, namely, a circular shape, and is perforated at the same locations for the shaft 30 and the several bolts 24. It is additionally matched by an upper plate 57 which is constructed in the same manner. The plates 56 and 57 are joined together by means of suitable machine bolts 58 which extend from the upper plate 57 to the lower plate 56. The bolts 58 pass through the lower plate and are threaded into the piston plate 51. The bolts 58 pull the piston assembly together. Preferably, three are used to fully assemble the equipment and define a properly constructed piston assembly 50.

Figure 2:
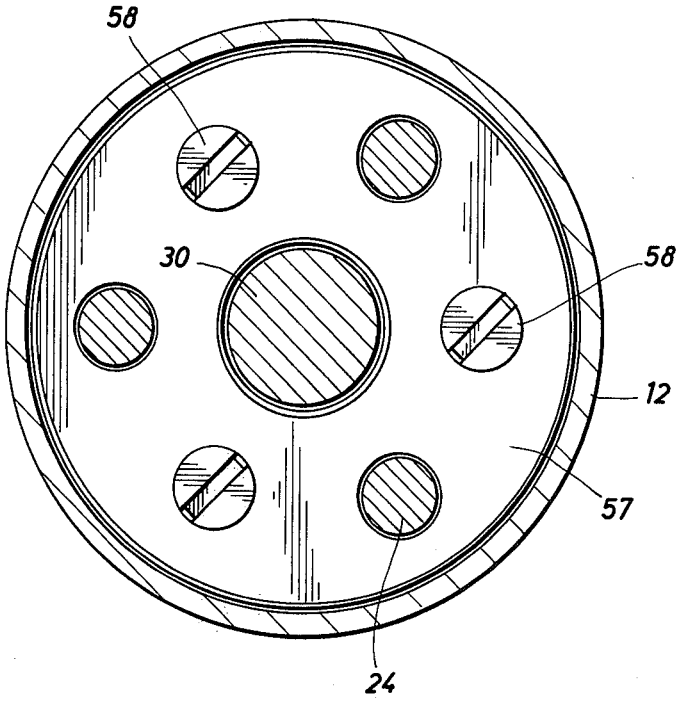
FIG. 2 is a sectional view along the line 2—2 of FIC 1 showing the top of the piston and guide posts extenc ing through it.

For a better understanding of the piston assembly 50, attention is momentarily directed to FIG. 2 of the drawings. There, the external, cylindrical shell 12 will be observed to encircle the top piece 57. It, in turn, receives several bolts 58. The bolts 58 are formed with a head suitable for flush mounting in countersunk bolt holes. In addition, FIG. 2 discloses the alignment achieved by the bolts 24 which extend fully through the piston assembly 50.

Figure 3:
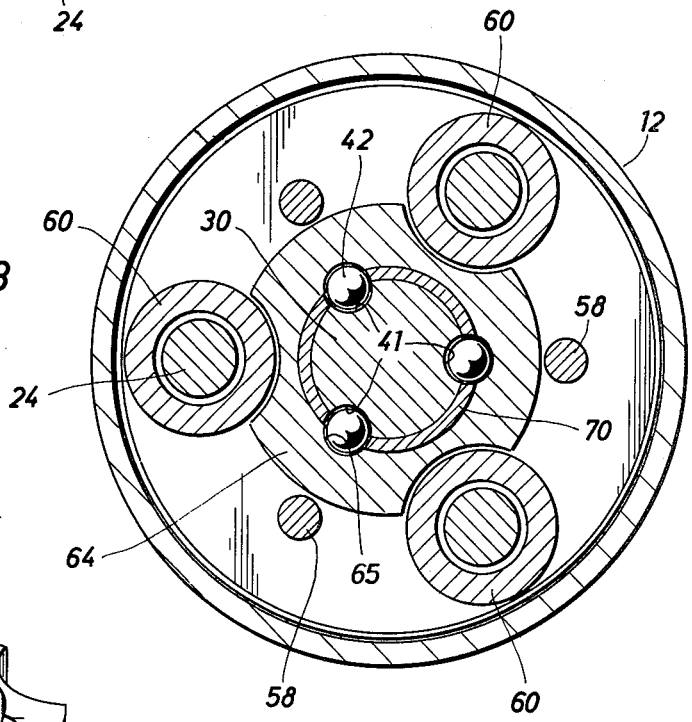
FIG. 3 is a sectional view through the center of th piston showing the arrangement of the piston on th central stem whereby ball bearings are used to conve axial movement of the piston into rotational movemer of the central stem.

FIG. 3 shows the piston assembly at a different sectional cut. There, the bolts 58 which hold the piston assembly together are shown on the exterior of the central component to be described. FIG. 3 further discloses a bearing or bushing 60 around each alignment rod 24. There are three rods in the preferred embodiment, and, accordingly, three bearings are used. The bearing or bushing 60 is captured between the parallel lower and upper plates 66 and 67.

The piston assembly includes a central bushing 64. The bushing 64 is generally cylindrical on its outer surface, except that it has lengthwise curved indentions along the exterior. There are three bearings or bushings 60, and, accordingly, FIG. 3 discloses three curved indentions so that the bearings or bushings nest against the central bushing 64. This prevents the bushing 64 from rotating. In other words, it is locked against rotation. Prevention of rotation is an important factor, as will be understood later.

Figure 4:
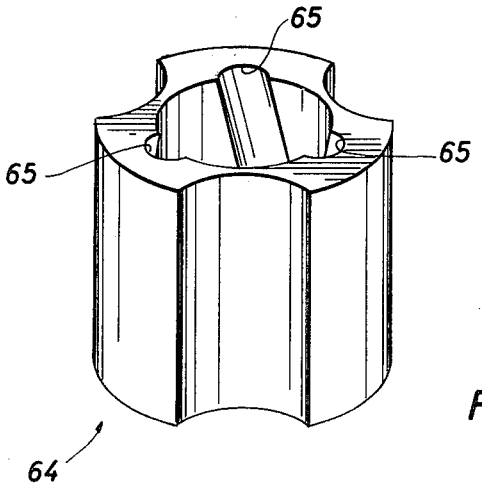
FIG. 4 is an elevated perspective view of a centr component of the piston showing details of construc tion.

The bushing 64 is formed with three helical grooves. They are identified by the numeral 65 shown in FIG. 4. Each helical groove, in cross section, has a semicircular profile. It will be observed in FIG. 3, also. FIG. 3 further discloses how the sphere 42 is nested in the semicircular groove in the central shaft 30. Accordingly, the ball or sphere 42 is received in a pair of opposing helical grooves. It is desirable to obtain 90° of rotation. The 90° of rotation is more easily obtained by rotating the helical groove 41 about 45° around the shaft 30, as depicted in FIG. 1. The mating groove 65 shown in FIG. 4, likewise, extends through about 45° of arc. In actuality, the groove 65 extends through at least 45°. The excess is defined at the end of the bushing 64 where the internal helical groove 65 comes to the end of the bushing so that the device can be assembled with the shaft. The total circumferential extent of the grooves thus combine to provide about 90° of relative rotation. The relative rotation is achieved by forcing the shaft 30 to rotate against the non-rotatable bushing 64. The bushing 64 is not free to rotate because it is locked as will be discovered on review of FIG. 3. The bushing 64 is free to move vertically in the cylindrical housing 12, but it cannot rotate.

A sleeve 70 is positioned between the bushing 64 and the shaft 30. It has three holes perforated in it which are slightly larger than the bearing 42. The sleeve 70 assures that the three ball bearings stay in alignment with each other.

While the foregoing describes all the components which comprise the actuator of the present invention, the operation of the invention should be considered. Presume for sake of discussion that the piston assembly 50 is at the upper end of the stroke. That is to say, it is at the upper end of its travel as shown in FIG. 1. Its upward motion is limited by the extent of the helical groove 41. When the ball 42 gets to the end of the groove, that limits its upward movement. Preferably, this limit coincides with the limit achieved when the piston travels against the upper cylinder head or end plate 13. In any case, fluid under pressure is introduced through the fitting 15 and the passage 17 to fill the upper chamber. As fluid under pressure is introduced, a pressure differential acting on the piston assembly 50 forces it downwardly. As explained before, the piston assembly 50 can move downwardly, but it is not free to rotate. Rotation is forbidden. Because it cannot rotate, it travels only axially of the cylindrical housing 12. Axial travel is accomplished by moving the entire piston assembly. However, the piston assembly is coacting with the shaft 30 in a manner such that the bearing 42 traverses the groove 41 and the groove 65 in the bushing 60 to cause the shaft to rotate. As the bearing traverses the grooves, the shaft 30 is rotated. Rotation is thus proportional to the movement of the piston assembly 50 and the angular deployment of the helical grooves. These grooves enable the shaft 30 to position the bearings 42 at all times in the two respective grooves which comprise the equipment. This is accomplished at several points around the shaft so that torque is imparted to the shaft. More importantly, the bearing 42 rotates between the grooves in shaft 30 and bushing 64 in the manner of a true antifriction bearing; that is, the bearing moves axially at one-half the rate of bushing 64. The grooves are preferably formed with a semicircular profile on examining a cut line transverse to the groove. Linear movement of the piston assembly in the cylindrical housing 12 is limited by the extent of the groove. When the bearing 42 reaches the bottom end of the groove 41, it limits travel of the piston assembly. Preferably, the device is sized such that the piston bottoms out against the bottom plate 14. Subsequently, the piston can be returned to the up position by introducing fluid under pressure through the fittings 16 to achieve the reverse sequence of operation.

The output of the device is achieved by 90° of rotation of the square drive heads 39 and 40 at opposite ends of the device. It is easy to make a connector or adap for transferring this motion to the stem of a plug or b valve.

The valve operator of the present invention idea operates with pneumatic pressure. It can be scaled su that only a few psi are required for its operation. A cordingly, the device is quite versatile in that a subst tial amount of torque can be obtained out of a relativ small structure. The structure, itself, is small, compa free of protruberances and is otherwise easily adapt to be joined to a valve stem for rotation.

The foregoing is directed to the preferred embo ment, but the scope of the present invention is det mined by the claims which follow.

I claim:

1. An actuator for rotating a valve through a select angle of rotation which comprises:

(a) an elongate, hollow body having a pair of faci end plates closing over the ends thereof;

(b) a transversely extending, movable piston means said hollow body;

(c) a central, rotatable shaft positioned in said bo and having at least one end protruding beyond c end plate and which protruding end is adapted rotate and to impart rotation to a valve connect to it;

(d) a guide means adjacent to said shaft and coope tive with said piston means limiting rotatio movement of said piston;

(e) means for introducing fluid under pressure l tween a selected end plate and said piston means force said piston means along said body;

(f) means coacting between said piston means a said shaft to impart rotation to said shaft on t occurrence of movement of said piston means, s means comprising:

(1) at least a pair of first grooves cut into said sh and extending about said shaft to partly encir said shaft by an extent related to the rotatio movement of said shaft;

(2) a spherical bearing in each of said grooves;

(3) a second groove for each of said first groo cut into said piston means and having a specifi angular extent around said shaft, said shaft a piston means being positioned such that one said first grooves cooperative with said seco groove jointly captures said bearing in rolli contact in said grooves and further preve escape of said bearing from said grooves;

(4) said bearing further forcing said shaft to rot as it moves along said grooves;

(g) a sleeve around said shaft where said sleeve received axially in a bushing having said seco grooves formed on an internal face thereof, a said bushing comprising at least a portion of s piston means, said sleeve comprising a hollc cylindrical sleeve with holes formed therein siz to permit said bearing to fit in said holes; and (h) first and second end located piston plates comp ing a portion of said piston means and which close said bushing, and which piston plates perforated at matching locations to enable s guide means to fully extend through said pist means and wherein said guide means comprises elongate bolt extending through said piston me which bolt is supported at said body end plates 2. The apparatus of claim 1 including three sets bearings and grooves positioned at 120° interv d said shaft and wherein said piston includes said
g at the center thereof.

he apparatus of claim 1 further including:

a seal means about said piston means for sealing gainst said body;

profiled and aligned means on said piston means ooperating with said guide means for angularly xing said piston means against rotation.

he apparatus of claim 3 including first, second and grooves of approximately equal angular extent on terior facing surface of said bushing which com- said second groove.

5. The apparatus of claim 4 wherein said grooves extend to the end of said bushing to provide a point of entry into said grooves for said spherical bearing with one bearing in each of said grooves.

6. The apparatus of claim 1 wherein said body is a hollow, right, cylindrical housing and said end plates are parallel, circular end plates and said means for introducing fluid comprises an inlet passage means in each of said end plates.

7. The apparatus of claim 6 wherein said piston means has a seal means engaging the wall of said housing and a seal means engaging said shaft to prevent leakage therepast.

* * * * *